US009539643B2

(12) United States Patent
Sun et al.

(10) Patent No.: US 9,539,643 B2
(45) **Date of Patent: *Jan. 10, 2017**

(54) MAKING METAL AND BIMETAL NANOSTRUCTURES WITH CONTROLLED MORPHOLOGY

(75) Inventors: Xueliang Sun, London (CA); Gaixia Zhang, London (CA); Mei Cai, Bloomfield Hills, MI (US); Shuhui Sun, London (CA); Ruying Li, London (CA)

(73) Assignee: GM Global Technology Operations LLC, Detroit, MI (US)

( * ) Notice: Subject to any disclaimer, the term of this patent is extended or adjusted under 35 U.S.C. 154(b) by 1191 days.

This patent is subject to a terminal disclaimer.

(21) Appl. No.: 12/704,786

(22) Filed: Feb. 12, 2010

(65) Prior Publication Data

US 2011/0197710 A1 Aug. 18, 2011

(51) Int. Cl.
*B22F 9/16* (2006.01)
*B22F 9/24* (2006.01)
*B22F 1/00* (2006.01)

(52) U.S. Cl.
CPC ..... *B22F 9/24* (2013.01); *B22F 1/0018* (2013.01); *B22F 1/0025* (2013.01); *B22F 2001/0029* (2013.01); *B22F 2001/0037* (2013.01)

(58) Field of Classification Search
CPC ..... B22F 9/24; B22F 1/18; B22F 1/25
USPC ..... 75/351
See application file for complete search history.

(56) References Cited

U.S. PATENT DOCUMENTS

| | | | | |
|---|---|---|---|---|
| 4,246,384 | A * | 1/1981 | Selman | 526/142 |
| 5,431,825 | A * | 7/1995 | Diel | 210/719 |
| 6,316,100 | B1 * | 11/2001 | Kodas et al. | 428/357 |
| 2005/0056118 | A1 | 3/2005 | Xia et al. | |
| 2008/0264205 | A1 * | 10/2008 | Zeng | B22F 9/24 75/352 |

OTHER PUBLICATIONS

Park, et al., "Chemical and Electronic Effects of Ni in Pt/Ni and Pt/Ru/Ni Alloy Nanoparticles in Methanol Electrooxidation," J. Phys. Chem. B 2002, 106, 1869-1877.*
Riegel, et al., "Reduction by Aluminum Powder in Aqueous Solution; Volumetric Determination of Iron," Analytical Chemistry, vol. 24, No. 11, Nov. 1952, pp. 1803-1806.*
(Continued)

*Primary Examiner* — Jessee Roe
*Assistant Examiner* — Christopher Kessler
(74) *Attorney, Agent, or Firm* — Reising Ethington P.C.

(57) ABSTRACT

A method of making metal nanostructures having a nanometer size in at least one dimension includes preparing an aqueous solution comprising a cation of a first metal and an anion, and mixing commercial elemental powder particles of an elemental second metal having a greater reduction potential than the first metal with the aqueous solution in an amount that reacts and dissolves all of the second metal and precipitates the first metal as metal nanostructures. The temperature and concentration of the aqueous solution and the selection of the anions and the second metal are chosen to produce metal nanostructures of a desired shape, for example ribbons, wires, flowers, rods, spheres, hollow spheres, scrolls, tubes, sheets, hexagonal sheets, rice, cones, dendrites, or particles.

13 Claims, 4 Drawing Sheets

(56) References Cited

OTHER PUBLICATIONS

P. Mauret and P. Alphonse, "Preparation and Catalytic Properties of Finely Divided Nickel Obtained by Reduction of Nickel Halide in Tetrahydrofuran or Ethanol," J. Org. Chem. 1982,47, 3322-3323.*
C.-L. Cheng, J.-S. Lin, Y-F. Chen, Fabrication and Growth Mechanism of Metal (Zn, Sn) Nanotube Arrays and Metal (Cu, Ag), Nanotube/Nonowire Junction Arrays, ScienceDirect, 2008, Materials Letters 62, 1666-1669, Elseiver.
J. Liu, A.I. Maaroof, L. Wieczorek, M.B. Cortie, Fabrication of Hollow Metal "Nanocaps" and their Red-Shifted Optical Absorption Spectra, Adv. Mater., 2005, 1276-1281, 17, Wiley-VCH Verlag GmbH & Co. KGaA, Weinham.
B.M. Quinn, C. Dekker, S.G. Lemay, Electrodeposition of Noble Metal Nanoparticles on Carbon Nonotubes, J. Am. Chem. Soc., 2005, 6146-6147, 127, American Chemical Society.
Y. Hou, H. Kondoh, T. Ohta, S. Gao, Size-Controlled Synthesis of Nickel Nanoparticles, Applied Surface Science, 2005, 218-222, 241, Elseiver.
F. Jia, L. Zhang, X. Shang, Y. Yang, Non-Aqueous Sol-Gel Approach Towards the Controllable Synthesis of Nickel Nanospheres, Nonwires, and Nanoflowers, Adv. Mater., 2008, 1050-1054, 20, Wiley-VCH Verlag GmbH & Co., KGaA, Weinheim.
Y. Sun., B.T. Mayers, Y. Xia, Template-Engaged Replacement Reaction: A One-Step Approach to the Large-Scale Synthesis of Metal Nanostructures with Hollow Interiors, American Chemical Society, 2002, 481-485, vol. 2, No. 5, Published on the Web Mar. 2002.
Y. Sun, Y. Xia, Triangular Nanoplates of Silver: Synthesis, Characterization, and Use as Sacrificial Templates for Generating Triangular Nanorings of Gold, Adv. Mater., 2003, 695-699, 15, No. 9, Wiley-VCH Verlag GmbH & Co., KGaA, Weinheim.
Y. Sun, Y. Xia, Mechanistic Study on the Replacement Reaction Between Silver Nanostructures and Chloroauric Acid in Aqueous Medium, J. Am. Chem. Soc., 2004, 3892-3901, 126, American Chemical Society.
X. Lu, H-Y. Tuan, J. Chen, Z-Y. Li, B.A. Korgel, Y. Xia, Mechanistic Studies on the Galvanic Replacement Reaction Between Multiply Twinned Particles of Ag and HAuC14 in an Organic Medium, J. Am. Chem. Soc., 2007, 1733-1742, 129, American Chemical Society.
P.R. Selvakannan, M. Sastry, Hollow Gold and Platinum Nanoparticles by a Transmetallation Reaction in an Organic Solution, Chem. Commun., 2005, 1684-1686, The Royal Society of Chemistry.
S. Shukla, A. Priscilla, M. Banerjee, R.R. Bhonde, J. Ghatak, P.V. Satyam, M. Sastry, Porous Gold Nanospheres by Controlled Transmetalation Reaction: A Novel Material for Application in Cell Imaging, Chem. Mater., 2005, 5000-5005, 17, Published on the Web Sep. 2005.
H.-P. Liang, H.-M. Zhang, J.-S. Hu, Y.G. Guo, L.-J. Wan, C.-L. Bai, Pt Hollow Nanospheres: Facile Synthesis and Enhanced Electrocatalysts, Angew. Chem. Int. Ed., 2004, 1540-1543, 43, Wiley-VCH Verlag GmbH & Co., KGaA, Weinheim.
H.-P. Liang, L.-J. Wan, C.-L. Bai, L. Jiang, Gold Hollow Nanospheres: Tunable Surface Plasmon Resonance Controlled by Interior-Cavity Sizes, J. Phys. Chem. B, 2005, 7795-7800, 109, American Chemical Society.
H.-P. Liang, Y.-G. Guo, H.-M. Zhang, J.-S. Hu, L.-J. Wan, C.-L. Bai, Controllable AuPt Bimetallic Hollow Nanostructures, Chem. Commun., 2004, 1496-1497, The Royal Society of Chemistry.
V. Bansal, H. Jani, J. Du Plessis, P.J. Coloe, S.K. Bhargava, Galvanic Replacement Reaction on Metal Films: A One-Step Approach to Create Nanoporous Surfaces for Catalysis, Adv. Mater, 2008, 717-723, 20, Wiley-VCH Verlag GmbH & Co., KGaA, Weinheim.
Z. Cao, D. Xiao, L. Kang, Z. Wang, S. Zhang, Y. Ma, H. Fu, J. Yao, Superhydrophobic Pure Silver Surface with Flower-Like Structures by a Facile Galvanic Exchange Reaction with [Ag(NH3)2] OH, Chem. Commun., 2008, 2692-2694, The Royal Society of Chemistry.
H. Winnischofer, T.C.R. Rocha, W.C. Nunes, L.M. Socolovsky, M. Knobel, D. Zanchet, Chemical Synthesis and Structural Characterization of Highly Disordered Ni Colloidal Nanoparticles, ACSNano, 2008, 1313-1319, vol. 2, No. 6, American Chemical Society.
L. Sun, Q. Chen, Y. Tang, Y. Xiong, Formation of One-Dimensionl Nickel Wires by Chemical Reduction of Nickel Ions Under Magnetic Fields, Chem. Commun., 2007, 2844-2846, The Royal Society of Chemistry.
C.-M. Liu, L. Guo, R.-M. Wang, Y. Deng, H.-B. Xu, S. Yang, Magnetic Nanochains of Metal Formed by Assembly of Small Nanoparticles, Chem. Commun., 2004, 2726-2727, The Royal Society of Chemistry.
H. Pan, B. Liu, J. Yi, C. Poh, S. Lim, J. Ding, Y. Feng, C.H.A. Haun, J. Lin, Growth of Single-Crystalline Ni and Co Nanowires via Electrochemical Deposition and their Magnetic Properties, J. Phys. Chem. B, 2005, 3094-3098, 109, American Chemical Society.
Z. Huajun, Z. Jinhaun, G. Zhenghai, W. Wei, Preparation and Magnetic Properties of Ni Nanorod Arrrays, Journal of Magnetism and Magnetic Materials, 565-570, 2008, 320, Elsevier.
C. Xu, Y. Hu, J. Rong, S.P. Jiang, Y. Liu, Ni Hollow Spheres as Catalysts for Methanol and Ethanol Electrooxidation, Electrochemistry Communications, 2007, 2009-2012, 9, Elsevier.
T. Hang, M. Li, Q. Fei, D. Mao, Characterization of Nickel Nanocones Routed by Electrodeposition Without any Template, Nanotechnoogy, 2008, 5 pp, 19, IOP Publishing Ltd.
G.B. Saupe, C.C. Waraksa, H.-N. Kim, Y.J. Han, D.M. Kaschak, D.M. Skinner, T.E. Mallouk, Nanoscale Tubules Formed by Exfoliation of Potassium Hexaniobate, Chem. Mater., 2000, 1556-1562, 12, American Chemical Society.
V.R. Stamenkovic, B.S. Mun, M. Arenz, K.J.J. Mayrhofer, C.A. Lucas, G. Wang, P.N. Ross, N.M. Markovic, Trends in Electrocatalysis on Extended and Nanoscale Pt-Bimetallic Alloy Surfaces, Nature Materials, 2007, 241-247, vol. 6, Nature Publishing Group.
M. Heemeier, A.F. Carlsson, M. Naschitzki, M. Schmal, M. Baumer, H.-J. Freund, Preparation and Characterization of a Model Bimetallic Catalyst: Co—Pd Nanoparticles Supported on A1203, Angew. Chem. Int. Ed., 2002, 4073-4076, 41, No. 21, Wiley-VCH Verlag GmbH & Co. KGaA, Weinham.
S. Link, Z.L. Wang, M.A. El-Sayed, Alloy Formation of Gold-Silver Nanoparticles and the Dependence of the Plasmon Absorption on their Composition, J. Phys. Chem. B, 1999, 3529-3533, 103, American Chemical Society.
S. Sun, Monodisperse FePt Nanoparticles and Ferromagnetic FePt Nanocrystal Superlattices, Science,1989, 1989-1992, 287, American Association for the Advancement of Science.
S.E. Skrabalak, L. Au, X. Li, Y. Xia, Facile Synthesis of Ag Nanocubes and Au Nanocages, Nature Protocols, 2007, 2182-2190, vol. 2, No. 9, Nature Publishing Group.

* cited by examiner

MAKING METAL AND BIMETAL NANOSTRUCTURES WITH CONTROLLED MORPHOLOGY

TECHNICAL FIELD

This disclosure relates to an easily-practiced method of making metal and bimetal nanostructures. More particularly, this disclosure relates to the use of selected galvanic replacement reactions using inexpensive metal powders to precipitate nanostructures of other metals useful in technological applications. This practice lends itself to the production of large amounts of metal and bimetal nanostructures and to making them with different morphologies.

BACKGROUND OF THE INVENTION

Metal nanomaterials have attracted considerable interest because of their unique size- and shape-dependent chemical and physical properties, as well as their potential applications in catalysis, information storage, electrochemical devices, and biological and chemical sensing. These small, metal-containing materials have been formed in various shapes such as wires or spheres. They are said to be nanomaterials and to have nanostructures where they have at least one dimension of interest of about one hundred nanometers or less. Such useful nanostructures have generally contained relatively expensive metals such as the noble metals, rare earth group metals, magnetic metals, and the like. And, as reported in the literature, the nanostructures have been made by complicated and sometimes low-yield processes. For example, most existing methods for synthesizing such materials focus on template or surfactant processes, electrochemical depositions, and sol-gel approaches. However, such methods require that either the template/surfactant/substrate be thoroughly removed for purifying the product or the reaction be conducted at elevated temperatures. There remains a need for simpler methods of producing metal nanostructures and for producing them in relatively large quantities.

SUMMARY OF THE INVENTION

The inventors herein have discovered that commercially available elemental metal powders, such as magnesium, aluminum, or manganese, having standard reduction potentials of relatively high negative values, may be used to precipitate other metals from a suitably prepared aqueous solution as nanometer size structures with morphologies that vary depending upon solution and process parameters. The elemental powder particles of magnesium, aluminum, or manganese are suitably of micron-size or larger and these elemental powder particles are simply added to an aqueous solution of nickel cations, platinum cations, or other selected metal (or metals) cations from which nanometer size structures are desired. The metal cations are, of course, paired with anions. Suitable anions may include, for example, chloride anions and nitrate anions. And it is observed that the selection of the anion may affect the morphology of the precipitated metal or bimetal nano-size structures. Also, the selection of the sacrificial metal (e.g., magnesium, aluminum, or manganese) affects the morphology of the precipitated metal.

Thus, in an illustrative embodiment, an aqueous solution of 0.5 M nickel chloride is prepared at about 25° C. (room temperature). A less than stoichiometric amount of magnesium powder is added to the aqueous solution and stirred into it. The elemental magnesium particles are fully consumed by a galvanic replacement reaction with the nickel in which nickel is precipitated as nanometer-size nanowires and the magnesium is wholly reacted and dissolved. The nickel precipitate is filtered and washed and recovered as useful nanomaterial, and the precipitate is examined and confirmed to be a desired nanomaterial. But the process does not require or use any nanomaterial in its practice before the final product is obtained. The elemental particles may be in the micrometer or even millimeter size range.

Two or more metals may be co-precipitated as bimetal nanostructures, or one metal may be precipitated first, followed by precipitation of a second metal.

Sometimes in this specification the metal used to precipitate the nanomaterials is called the sacrificial metal because it is reacted and dissolved as the desired nanomaterial is precipitated. Of course the dissolved "sacrificial" metal is readily recovered for reuse from its solution.

Accordingly, the invention uses selected galvanic replacement reactions in the synthesis of various metal nanostructures in a one-step, cost-effective way with the potential for easy large volume production of nanomaterials. The intrinsic properties of the metal nanostructures may be tailored by controlling their precipitation practice and, thus, morphology, structure, composition, and crystallinity. The methods use very inexpensive, commercially available elemental metal powders, rather than any pre-synthesized nanostructures or bulk materials, to reduce the desired metal salt precursors.

Using such metal powders, for example but not limited to, Mg or Al, as sacrificial metals has many advantages. For example, their redox pair potentials are very low [$Mg^{2+}/Mg$ (−2.356 V) and $Al^{3+}/Al$ (−1.676 V) versus the standard hydrogen electrode (SHE)] and they are very reactive, so that most metals (as long as their redox potentials are higher than that of $Mg^{2+}/Mg$ or $Al^{3+}/Al$) can be reduced from their corresponding salt solutions. Manganese may also be used as a precipitant for metals with a higher reduction potential. Second, the reactions can be conducted very efficiently, even at room temperature. Third, the products can be purified and collected easily compared with those obtained involving a surfactant or template.

Fourth, the amount of product can easily be scaled up by simply multiplying the amounts of the low cost elemental metal reactants, which enables mass production. Fifth, they are commercially available and much cheaper than commonly used Ag, Te, Cu, Co, and Ni bulk metals (let alone their pre-synthesized nanostructures). Finally, by using metals such as Mg, Al, or Mn, the as-synthesized metal nanostructures are related to the difference in the metal potentials (net potentials), as well as to the composition and the concentration of the metal salt precursors rather than to the structures of the sacrificial metal templates. This makes nanostructure synthesis much more controllable and reproducible.

The methods of the invention employ the galvanic replacement reaction and use commercially available elemental metals rather than pre-synthesized, expensive nanostructures as sacrificial metals for the mass synthesis of transition and rare-earth metals, and metal composites, which have controlled novel nanostructures. These metal and bimetal nanostructures may include, but are not limited to, ribbons, wires, flowers, rods, spheres, hollow spheres, scrolls, tubes, sheets, hexagonal sheets, rice, cones, dendrites, bricks, or particles. Because of their well-controlled structures, high surface area and unique properties, such metal and bimetal nanostructures have great potential in fuel cell, hydrogen/energy storage, pollutant purification, catalysis, electronics, supercapacitors, nanoactuators, and biological and chemical sensing applications.

DESCRIPTION OF PREFERRED EMBODIMENTS

Figure 1A:
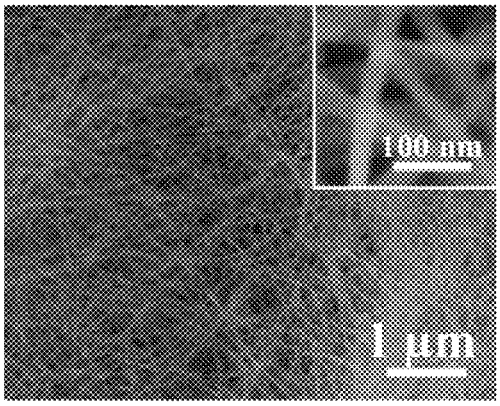
FIG. 1A is an SEM image of Ni nanowires synthesized from Mg and $NiCl_2$.

One embodiment includes a method of making metal nanostructures having a nanometer size (about 100 nm or less) in at least one dimension. The method involves the systematic control of the dimensions and shapes of metal nanostructures. The method includes preparing an aqueous solution including a cation of a first metal(s) and an anion. A quality of water is used that does not interfere with the practice of the process, for example deionized water. Then commercial powder particles of an elemental second metal having a greater reduction potential than the first metal are mixed with the aqueous solution in an amount that dissolves all of the second metal and precipitates the first metal as metal nanostructures. For example, the commercial powder particles may be, but are not limited to, aluminum (99.5% purity), magnesium (99.6% purity), or manganese (>99% purity). The powder particles suitably may be micrometer size, for example between 1 and 100 micrometers or larger. In other embodiments, the powder particles may be nanometer size, for example about 100 nanometers, or they may be larger such as millimeter size. The reaction may be conducted at room temperature (or other determined temperature) without the use of any surfactant. The resulting metal nanostructures may be washed, filtered, and dried to harvest them. The metal nanostructures are easily purified and collected. In addition, the amount of metal nanostructures produced can easily be scaled up by simply multiplying the amounts of reactant, which enables mass production (for example, kilograms).

The temperature and concentration of the aqueous solution and the selection of the anions and the second metal are chosen (often by experiment) to produce the metal nanostructures of a desired shape. For example, the metal nanostructures may have a shape of at least one of ribbons, wires, flowers, rods, spheres, hollow spheres, scrolls, tubes, sheets, hexagonal sheets, rice, cones, dendrites, bricks, or particles. However, the metal nanostructures are not limited to these shapes. The nanoscroll shape, for example, may consist of a single sheet rolled up into a tube-like nanostructure, with open-ended tips, and seamless in structure. The nanoscroll may be one-sided (rolled in one direction) or two-sided (rolled from each end in opposite directions).

In various embodiments, the elemental second metal for precipitation of the nanomaterial may be, but is not limited to, magnesium, aluminum, or manganese. The first metal may, for example, be a noble metal, transition metal, or rare earth metal. The aqueous solution may include an anion such as chloride or nitrate. For example, the aqueous solution may be, but is not limited to, $NiCl_2$ solution, $Ni(NO_3)_2$ solution, $FeCl_2$ solution, or $FeCl_3$ solution. Other anions may be tried and evaluated for the formation of different nanostructures.

In other embodiments, bimetal nanostructures may be prepared, for example including noble-noble, noble-magnetic, or magnetic-magnetic elements. In other embodiments, multi-metal nanostructures may be prepared including more than two metals. There are various methods used to prepare bimetal nanostructures. One embodiment includes a one-step approach of using a sacrificial metal (Mg, Al, Mn, or other metals) to reduce a solution of two metal salts (the precursors of the desired bimetal composite) simultaneously. Thus, according to this method, an aqueous solution is prepared including a cation of a first metal and a first anion, and a cation of a second metal and a second anion. Then, powder particles of a suitable and selected elemental third metal having a greater reduction potential than the first and second metals are mixed with the aqueous solution in an amount that dissolves all of the third metal and precipitates the first and second metals as bimetal nanostructures. For example, the aqueous solution may include $H_2PtCl_6$ and $NiCl_2$, which results in PtNi nanostructures when precipitated, for example by Mg or Al. The temperature and concentration of the aqueous solution and the selection of the anions and the third metal are chosen to produce bimetal nanostructures of a desired shape. The shape of the bimetal nanostructures is a result of the process parameters, and may be as described above for the metal nanostructures.

Another method of preparing bimetal nanostructures includes a two-step approach. First the replacement reaction is carried out to synthesize metal nanostructures (for example, Ni nanoribbons), and then the as-synthesized metal nanostructures are used as the sacrificial template to obtain (for example, Ni-based) bimetal nanostructures. In other words, the precipitated metal nanostructures are mixed with a second aqueous solution including a cation of a third metal and an anion. A portion of the metal nanostructures may be dissolved. Then the third metal is precipitated on the first precipitated metal nanostructures to form bimetal nanostructures of a desired shape.

Several factors play key roles in the morphological and structural control of the metals formed using the methods of the invention. The first factor relates to the net redox potential between the redox pairs of the sacrificial metal and the target metal nanomaterial to be synthesized. If different sacrificial metals are used to reduce the same metal salts under the same conditions, different metal nanostructures are often obtained. This may be called the Sacrificial Metal Potential Effect. However, if the same sacrificial metals and same anions are used, but with different cations, or with the same cations having different valent states (e.g. $Fe^{2+}$ and $Fe^{3+}$), different structures are often generated. This may be called the Cation Potential Effect. Another important factor is the anion effect which arises from the influence of the existing anions in solution on the standard reduction potentials of the metals and from the differences in anion electronic structures and polar properties as well. In short, the net redox potential results from two main influences—the use of different sacrificial metals and/or different cations (or the same cations with different valent states), and the anion effect. In addition, factors such as the metal salt concentration or the temperature may alter the structure of the synthesized metals.

Various experimental examples were conducted according to the methods of the invention. In some examples, Ni was used as the target metal to produce different Ni structures such as Ni nanowires that are approximately 15 nm in diameter, nanoribbons that are a few nanometers thick, and self-assembled nanoflowers that have a three-dimensional, porous structure.

In one example, a controlled amount of freshly prepared Ni salt aqueous solution was quickly added to a glass vial that contained a predetermined amount of commercially available sacrificial metal powder, in this case Mg. The magnesium particles were of commercial grade (normally 99% or greater purity) and had particle sizes in the range from one micrometer to several hundred micrometers.

To synthesize Ni nanowires, a replacement reaction between the Mg powder (60 mg) and $NiCl_2$ solution (0.5M, 6 ml) was used. The atomic amount of $Ni^{2+}$ was greater than that of Mg so that the Mg could be completely oxidized to $Mg^{2+}$, precipitating Ni nanowires only. The Ni nanowires were synthesized based on the following replacement reaction:

$$Mg(s)+Ni^{2+}(aq)=Ni(s)+Mg^{2+}(aq)$$

Significantly, the amount of product can be easily scaled up to kilogram scale in one pot by simply multiplying the amounts of reactants. After the Ni reduction reaction was complete, the product was washed several times in deionized water, collected by filtration, and dried in an oven at 60° C.

Then, X-ray diffraction (XRD) measurements were performed on the Ni product using a Bruker D8 Discover diffractometer operating at 40 kV and 40 mA, with CuKα radiation (λ=0.154 nm). The powder XRD pattern of the Ni product matched well with the Ni face-centered cubic (fcc) structure (JCPCDS, 04-0850), indicating its good crystallinity.

Field emission scanning electron microscopy (FESEM) was carried out on the product using a Hitachi S-5200 microscope operating at 5 kV. FIG. 1A, a scanning electron microscopy (SEM) image, shows the numerous uniform Ni nanowires that were obtained, which are approximately 15 nm in diameter and tens of micrometers long.

Figure 1B:
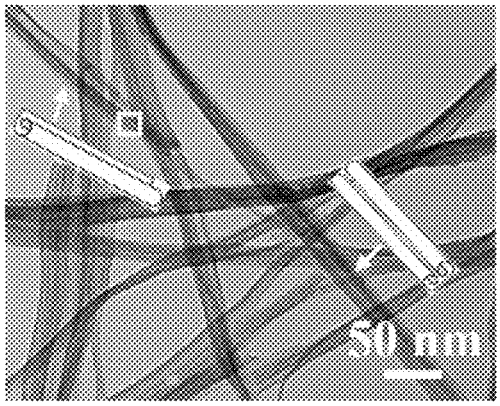
FIG. 1B is a TEM image of Ni nanowires synthesized from Mg and $NiCl_2$.

In addition, regular transmission electron microscopy (TEM) observations were performed on the Ni nanowires with a Philips CM10 microscope at an accelerating voltage of 100 kV. As shown in the higher magnification of FIG. 1B, obvious tube-like nanostructures with asymmetric mass contrasts, as well as the appearance of the sheet-like structures at the edges, are seen, which indicate that the Ni nanowires actually are scroll-like structures. The partially unscrolling of some scrolls was due to a long-time sonication (1 h, in order to obtain a better sample dispersion) during TEM sample preparation process.

Furthermore, high-resolution transmission electron microscopy (HRTEM), electron diffraction, bright- and dark-field images were obtained with a JEOL 2010F microscope, operating at 200 kV. Energy dispersive X-ray (EDX) was carried out using a Hitachi S-4500 FESEM and a JEOL 2010F HRTEM. The EDX demonstrated the purity of Ni product. HRTEM and fast Fourier transformation (FFT) further confirmed that the Ni nanowires were single crystalline. The scroll-like Ni nanowires originated from 2D nanosheets that possess a large difference in interplanar distances in two perpendicular directions. Therefore, whenever there is a structural stress, their unique structure will promote a rolling along the axis parallel to the plans that have the larger interplanar separation, to release the stress.

Figure 2A:
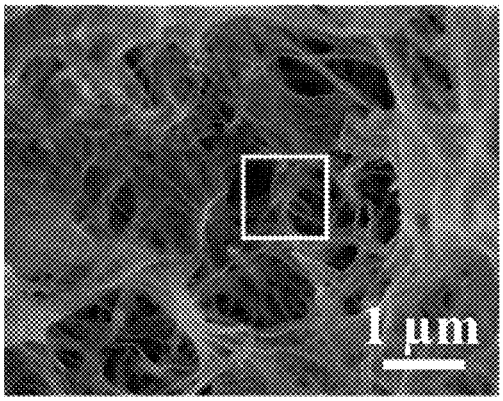
FIG. 2A is an SEM image of Ni nanoribbons synthesized from Mg and $Ni(NO_3)_2$.
Figure 2B:
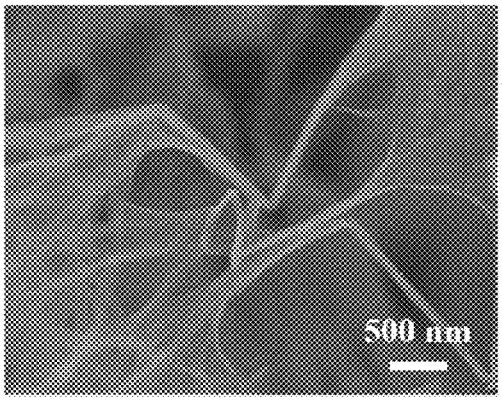
FIG. 2B illustrates an SEM image of Ni nanoribbons synthesized from Mg and $Ni(NO_3)_2$.

Another experimental example was performed as described above, but using a different anion in the Ni solution. Specifically, the $NiCl_2$ solution was substituted with $Ni(NO_3)_2$. In addition to the reaction rate becoming a little slower, both the morphology and structure of the Ni product changed. FIG. 2A shows a cotton-puff-like structure which is composed of numerous nanoribbons. The EDX spectrum revealed the purity of the Ni nanoribbons. These Ni nanoribbons are a few nanometers thick, several hundreds of nanometers wide, and several micrometers long. They are also smooth, flat, and almost transparent, although they sometimes randomly bend, overlap, or roll up, as shown in the SEM FIG. 2B. The well-ordered and smooth lattice fringes in the HRTEM as well as the sharp spots in the corresponding FFT indicated the crystallinity of the nanoribbons. Clearly visible fringes extended in two directions, with the same lattice spacing of 0.176 nm, revealing that the two growth directions (width and length) were along <100> orientations. Thus, no preferring rolling direction exists in the original sheets of the nanoribbons which results in randomly bending, overlapping or partial rolling up of the structure, to release the stress whenever it occurs.

Comparing these scroll-like Ni nanowires and the Ni nanoribbons that were synthesized under the same conditions but with different metal salts—$NiCl_2$ and $Ni(NO_3)_2$—the effect of the anions on nanostructure formation can be seen. As mentioned above, the $Ni(NO_3)_2$ reaction is slower than the $NiCl_2$ reaction because the existing anions appear to affect the standard reduction potentials of the metals to be reduced, which then affects the reaction rate, the growth speeds of different crystal faces, and then the final morphology. In addition, the electronic structures and the polar properties of the anions may also affect the aggregation path of the synthesized metal atoms and, therefore, the final morphology of the metal structure.

Figure 3A:
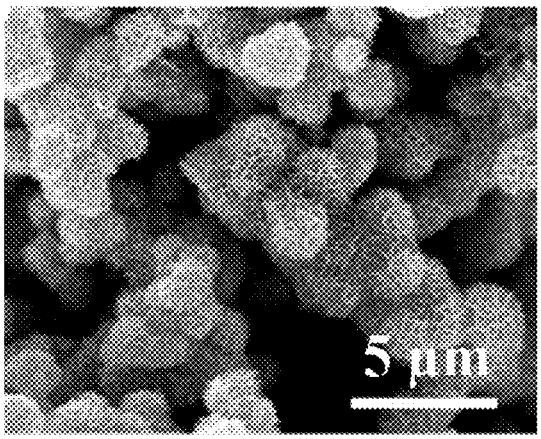
FIG. 3A is an SEM image of Ni nanoflowers synthesized from Al and $NiCl_2$.
Figure 3B:
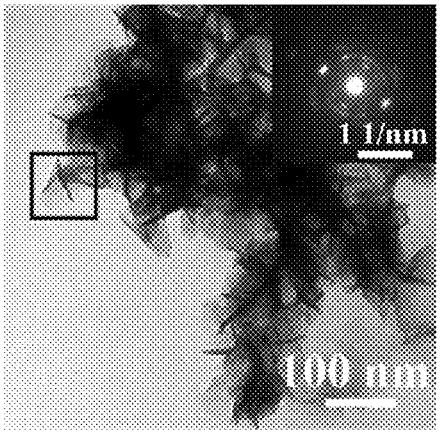
FIG. 3B is a TEM image of Ni nanoflowers synthesized from Al and $NiCl_2$.

The choice of sacrificial metal also influences the morphology of the product. For example, in another experimental example, Al was used instead of Mg as the sacrificial metal, with $NiCl_2$ as the precursor. Again, the aluminum powder was of commercial grade purity and had particle sizes in the range from 1 micrometer to several hundred micrometers. Flower-like Ni nanostructures were obtained. The SEM image in FIG. 3A reveals that the entire Ni flower structure, approximately 1.5 μm in diameter, is constructed of several dozen nanosheets with smooth surfaces. These nanosheets are approximately 10 nm thick and a few hundred nanometers wide, connecting to form three-dimensional flower-like structures. In addition, many of the nanosheets bend at their edges, giving the impression of real nanopetals. The purity of the Ni nanoflowers was demonstrated by the EDX spectrum. Referring to FIG. 3B, a representative TEM image confirms that the flower structure is formed from uniform petal-like nanosheets and no solid core was observed, which is consistent with the SEM results. The inset of FIG. 3B shows a selected area electron diffraction (SAED) pattern that was taken from several Ni nanopetals (squared in FIG. 3B) and indicates the crystallinity of the structures. This was also confirmed by the HRTEM image with the FFT obtained from one petal of the Ni nanoflower. The 0.248 nm lattice spacing matched the interplanar separation of the (220) planes of fcc Ni.

Comparing the scroll-like Ni nanowires and the Ni nanoflowers synthesized under the same conditions but with different sacrificial metals (Mg and Al), the effect of the redox potentials on the formation of the nanostructures may be seen. That is, the net redox potential of 1.419 V between $Ni^{2+}/Ni$ (−0.257 V) and $Al^{3+}/Al$ (−1.676 V) is much smaller than 2.099 V, which is the net potential between $Ni^{2+}/Ni$ (−0.257 V) and $Mg^{2+}/Mg$ (−2.356V). Thus, the replacement reaction of the former is slower than that of the latter. Furthermore, there is always a very thin $Al_2O_3$ passivation layer on the Al surface, which also reduces the reaction rate. Therefore, with a lower reaction rate, the Ni atoms reduced by Al will have more time to aggregate and form a thicker nanosheet than those synthesized with Mg.

Figure 4:
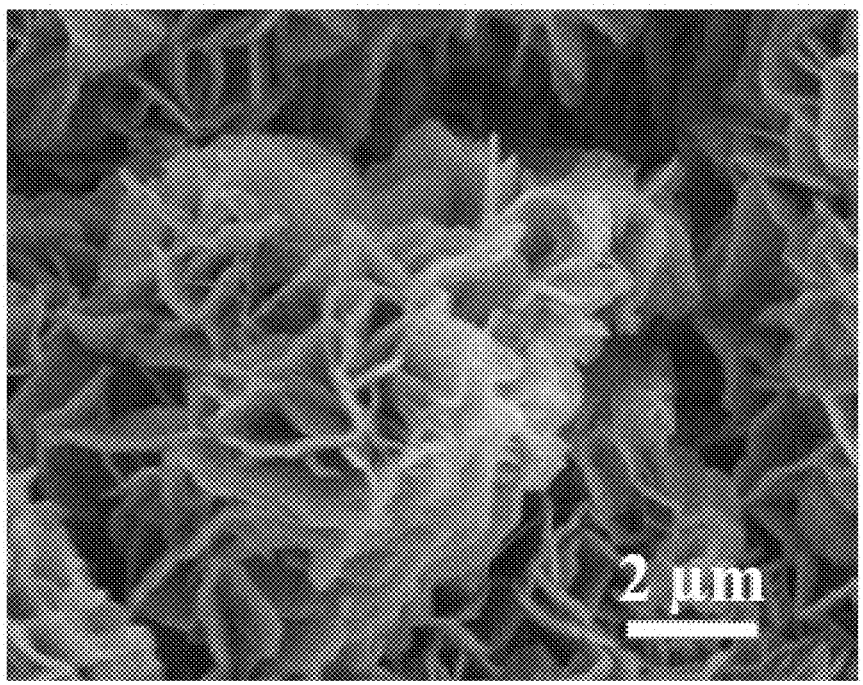
FIG. 4 is an SEM image of Ni nanoflowers synthesized from Al and $Ni(NO_3)_2$.

In another example, the replacement reaction between Al and $Ni(NO_3)_2$ was used to produce Ni nanoflowers, shown in FIG. 4. These Ni nanoflowers were similar to those obtained with Al and $NiCl_2$, but were composed of a number of bigger nanosheets with a greater average thickness.

Figure 5:
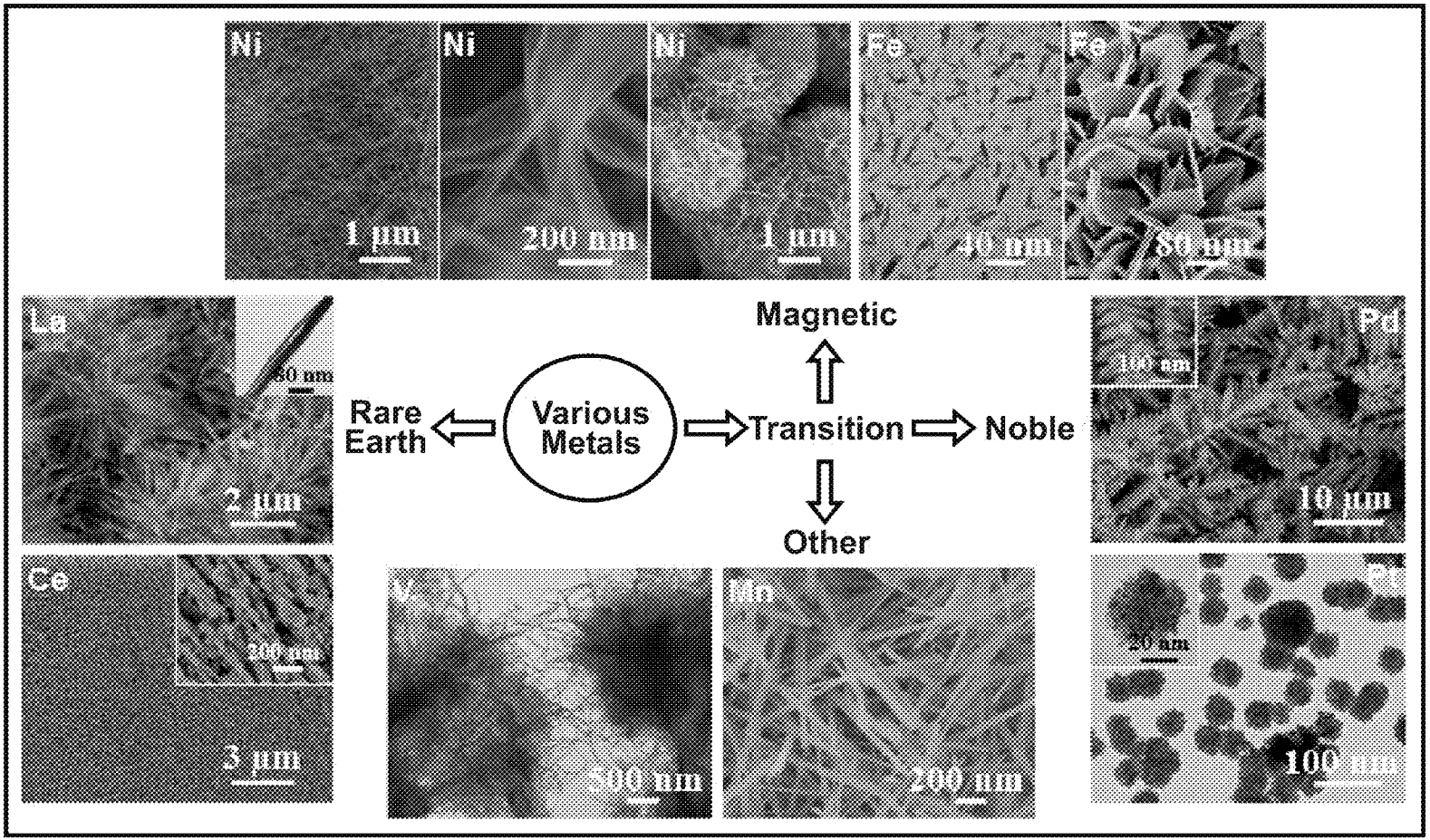
FIG. 5 illustrates Ni nanowires, Ni nanoribbons, Ni nanoflowers, Fe nanorods, Fe nanosheets, fern-like dendritic Pd nanostructures, porous Pt nanospheres, V nanoribbons, Mn nanowires, La nanoscrolls, and Ce nanobricks.

Various other metal nanostructures, including most of the transition metals and rare earth group, can be effectively synthesized by the methods of the invention described above. In experimental examples, using Mg as the sacrificial metal and chloride compounds of the desired metals as the precursors only, two representative metals were sampled from each group (magnetic, noble, and other transition metals, as well as rare-earth) to demonstrate the power of this approach. Referring to FIG. 5, the La nanoscrolls were synthesized from $LaCl_3$, the Fe tiny nanorods/rice were synthesized from $FeCl_3$, the Fe smooth nanosheets were synthesized from $FeCl_2$, the fern-like dendridtic Pd nanostructures were synthesized from $K_2PdCl_4$, the self-assembled porous Pt nanospheres were synthesized from $H_2PtCl_6$, the V nanoribbons were synthesized from $VCl_3$, the Mn nanowires were synthesized from $MnCl_2$, and the Ce nanobricks consisting of numerous porous nanoparticles were synthesized from $CeCl_3$. The purities of the products were confirmed by EDX spectra, where the small amount of oxygen in some of the nanoproducts was due to the easy oxidation intrinsic property of metals, especially in nanoscale, when exposed in air. The successful synthesis of the Pt porous nanospheres demonstrates that noble metal acids may be used in the methods of the invention in addition to the metal salts disclosed above. Further, as shown in FIG. 5, using Fe compounds such as $FeCl_2$ and $FeCl_3$ results in different Fe nanostructures.

In another example, Ni nanoscrolls were prepared using commercially available Mn powder as the sacrificial metal used to reduce a $NiCl_2$ metal salt precursor at room temperature. No surfactant or catalyst was used. The aqueous $NiCl_2$ (175 ml, 2 M) solution was quickly added in a 250 mL beaker which contained 16.6 g commercially available sacrificial Mn powder. $Ni^{2+}$ was reduced according to the following reaction:

$$Mn(s)+Ni^{2+}(aq)=Ni(s)+Mn^{2+}(aq)$$

The atomic amount of Ni was greater than that of Mn to ensure that Mn atoms could be completely oxidized into $Mn^{2+}$, precipitating only Ni nanoscrolls. After the reaction was complete, the product was washed several times with deionized water, filtered, and dried in an oven at 60° C. The resulting Ni nanoscrolls were single crystals and quite uniform in size. They were a few tens of nanometers in diameter, for example 20-30 nm, and several tens of micrometers of more in length.

Figure 6A:
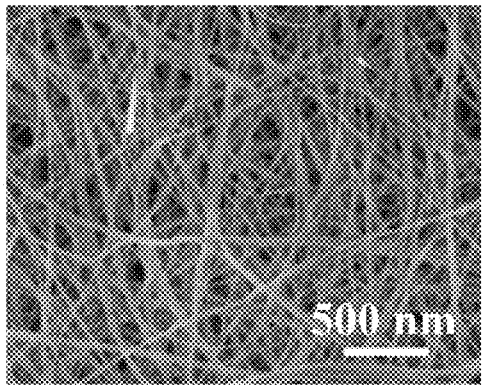
FIG. 6A is an SEM image of Pt nanoparticle-Ni nanowire bimetal composites synthesized using a one-step approach.
Figure 6B:
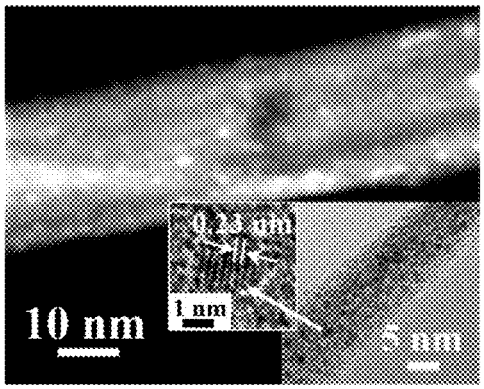
FIG. 6B is a dark-field TEM image with bright-field TEM images in insets of Pt nanoparticle-Ni nanowire bimetal composites synthesized using a one-step approach.

Experimental examples were also carried out to produce the bimetal nanostructures. Ni-based nanocomposites (e.g. PtNi, AuNi, etc.) were synthesized using the two different approaches described above. The first method, using sacrificial metals to reduce a mixture of two co-dissolved metal salts simultaneously in one step, was employed to synthesize PtNi. $H_2PtCl_6$ and $NiCl_2$ were used as precursors in an atomic ratio of 3:40. As shown in FIG. 6A (an SEM image) and FIG. 6B (a dark-field TEM image with bright-field TEM images in insets), very uniform, large-scale Pt nanoparticle—Ni nanowire composites were obtained. The Pt—Ni nanostructures were approximately 15 nm in diameter and several tens of micrometers long. Further, the Pt nanoparticles were distributed very uniformly and were approximately 2 nm in size, with an obvious 0.23 nm lattice spacing corresponding to the (111) planes of the Pt fcc structure, on the Ni nanowires. The EDX spectrum also revealed that the product contained Ni and Pt in a ratio of 2.5:40, which matches well with the original atomic ratio of Pt and Ni in their precursors.

Figure 7A:
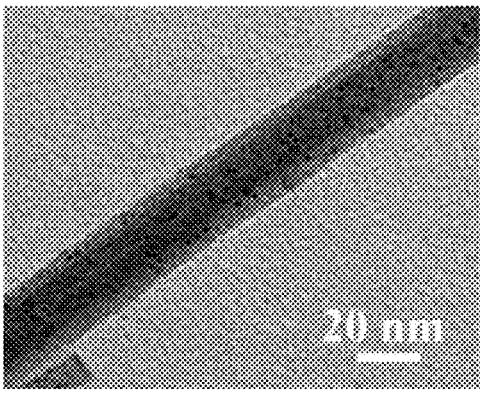
FIG. 7A is a TEM image of Au particle-Ni nanowire bimetal composites synthesized using a two-step approach.
Figure 7B:
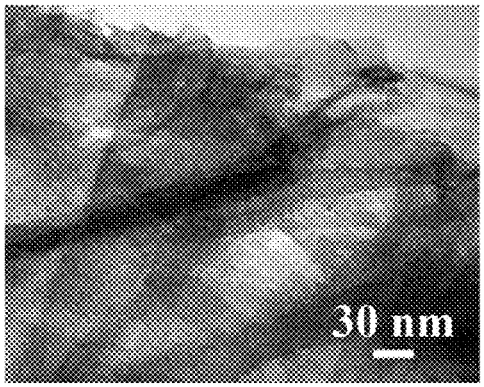
FIG. 7B is a TEM image of Au particle-Ni nanoribbon bimetal composites synthesized using a two-step approach.

The second method of making bimetal nanostructures was employed to synthesize AuNi. In this method, the replacement reaction was used to synthesize Ni nanostructures and then the as-synthesized Ni was employed as the sacrificial template to obtain Ni-based bimetal nanocomposites. Both Ni nanowires and Ni nanoribbons were prepared and used separately as sacrificial metal templates. The Ni nanowires and Ni nanoribbons were each mixed with an aqueous solution of $HAuCl_4$ to produce Au nanoparticles-Ni nanowires (FIG. 7A) and Au nanoparticles-Ni nanoribbons (FIG. 7B), respectively. The TEM images of FIGS. 7A and 7B show the Au nanoparticles distributed uniformly on the Ni nanowires and Ni nanoribbons, respectively. The corresponding EDX spectra further confirm that the bimetal nanostructures are composed of Au and Ni.

The practice of the invention has been illustrated with certain embodiments but the scope of the invention is not limited to such examples.

The invention claimed is:

1. A method of making metal nanostructures consisting of elemental metal and having a nanometer size in at least one dimension, the following first two steps (i and ii) of the method consisting of:

(i) preparing an aqueous solution consisting of water as the solvent and cations of a first metal and anions and cations associated with the cations of the first metal, the first metal being selected from the group consisting of cerium, gold, lanthanum, iron, manganese, nickel, palladium, platinum, and vanadium, the solution being formed at a predetermined concentration of the first metal cations and with or without heating the aqueous solution above room temperature; and (ii) mixing powder particles consisting of an elemental second metal, having a greater reduction potential than the first metal, with the aqueous solution in an amount that reacts and dissolves all of the second metal and precipitates particles consisting of the first elemental metal as metal nanostructures, the second elemental metal being selected from the group consisting of aluminum, magnesium, and manganese, the powder particles of the elemental second metal having particle sizes greater than one micrometer and being used in a less than stoichiometric amount for the reduction and precipitation of all of the first metal in the aqueous solution, the temperature and concentration of the aqueous solution and the selection of the associated anion and the second metal producing the metal nanostructures; and the method thereafter comprising separating the precipitate from the solution and confirming the presence of the elemental metal nanostructures.

2. A method as set forth in claim 1 wherein the aqueous solution is of a chloride compound of the first metal.

3. A method as set forth in claim 1 wherein the aqueous solution is one of $NiCl_2$ solution, $Ni(NO_3)_2$ solution, $FeCl_2$ solution, $FeCl_3$ solution, $K_2PdCl_4$ solution, $H_2PtCl_6$ solution, $VCl_3$ solution, $MnCl_2$ solution, or $CeCl_3$ solution.

4. A method as set forth in claim 1 further comprising washing, filtering, and drying the metal nanostructures.

5. A method as set forth in claim 1 further comprising making bimetal nanostructures having a nanometer size in at least one dimension comprising:

preparing a second aqueous solution consisting of water as the solvent and cations of a third metal and associated anions, the first metal and the third metal being different metals and each metal being selected from the group consisting of cerium, gold, lanthanum, iron, manganese, nickel, palladium, platinum, and vanadium;

mixing the precipitated first metal nanostructures with the second aqueous solution in an amount that reacts and dissolves a portion of the first metal nanostructures and precipitates the third metal on the undissolved first metal nanostructures to form bimetal nanostructures consisting of the first metal element and the third metal element.

6. A method of making bimetal nanostructures having a nanometer size in at least one dimension, the following first two steps (i and ii) of the method consisting of:

(i) preparing an aqueous solution consisting of water as the solvent and a cation of a first metal, any cation associated with the cation of the first metal, and a first anion, and a cation of a second metal, any cation associated with the cation of the second metal and a second anion, the first metal and the second metal being different metals and each metal being selected from the group consisting of cerium, gold, lanthanum, iron, manganese, nickel, palladium, platinum, and vanadium, the solution being formed at a predetermined concentration of the first and second metal cations and with or without heating the aqueous solution above room temperature; and (ii) mixing powder particles consisting of an elemental third metal having a greater reduction potential than the first and second metals with the aqueous solution in an amount that reacts and dissolves all of the third metal and precipitates particles consisting of the first and second metals as distinct elements in bimetal nanostructures, the elemental third metal being selected from group consisting of aluminum, magnesium, and manganese, the powder particles of the elemental third metal having particle sizes greater than one micrometer and being used in a less than stoichiometric amount for the reduction and precipitation of all of the first metal and second metal in the aqueous solution, the temperature and concentration of the aqueous solution and the selection of the anions and the third metal producing the bimetal nanostructures; and the method thereafter comprising separating the precipitate from the solution and confirming the presence of the bimetal nanostructures consisting of the first metal element and the second metal element.

7. A method as set forth in claim 6 wherein the aqueous solution initially consists of $H_2PtCl_6$ and $NiCl_2$, and wherein the resulting bimetal nanostructures are PtNi nanostructures.

8. A method as set forth in claim 6 wherein the aqueous solution contains both nickel cations and platinum-containing ions and elemental nickel and platinum are precipitated as bimetal nanostructures.

9. A method as set forth in claim 6 wherein the aqueous solution contains both nickel cations and gold-containing ions and elemental nickel and gold are precipitated as bimetal nanostructures.

10. A method as set forth in claim 6 further comprising washing, filtering, and drying the bimetal nanostructures.

11. A method of making nickel nanostructures consisting of elemental nickel and having a nanometer size in at least one dimension, the following first two steps (i and ii) of the method consisting of:

(i) preparing an aqueous solution consisting of water as the solvent and a nickel cation and an associated anion, the solution being formed at a predetermined concentration of the nickel cation; and (ii) mixing powder particles consisting of an elemental second metal having a greater reduction potential than nickel with the aqueous solution in an amount that reacts and dissolves all of the second metal and precipitates particles consisting of elemental nickel metal as nickel nanostructures, the second elemental metal being selected from the group consisting of aluminum, magnesium, and manganese, the powder particles of the elemental second metal having particle sizes greater than one micrometer and being used in a less than stoichiometric amount for the reduction and precipitation of all of the nickel in the aqueous solution, the temperature and nickel cation concentration of the aqueous solution and the selection of the associated anion and the second metal producing the nickel nanostructures; and the method thereafter comprising separating the precipitate from the solution and confirming the presence of the elemental nickel nanostructures.

12. A method as set forth in claim 11 wherein the aqueous solution is one of a $NiCl_2$ solution and a $Ni(NO_3)_2$ solution.

13. A method of making bimetal nanostructures consisting of two elemental metals, the nanostructures having a nanometer size in at least one dimension, the method comprising:

preparing an aqueous solution consisting of water as the solvent and cations of a first metal and anions and cations associated with the cations of the first metal, the first metal being selected from the group consisting of cerium, gold, lanthanum, iron, manganese, nickel, palladium, platinum, and vanadium, the solution being formed at a predetermined concentration of the first metal cations and with or without heating the aqueous solution above room temperature;

mixing powder particles consisting of an elemental second metal, having a greater reduction potential than the first metal, with the aqueous solution in an amount that reacts and dissolves all of the second metal and precipitates particles consisting of the first elemental metal as metal nanostructures, the second elemental metal being selected from the group consisting of aluminum, magnesium, and manganese, the powder particles of the elemental second metal having particle sizes greater than one micrometer and being used in a less than stoichiometric amount for the reduction and precipitation of all of the first metal in the aqueous solution, the temperature and concentration of the aqueous solution and the selection of the associated anion and the second metal producing the metal nanostructures;

separating the precipitate from the solution and confirming the presence of the elemental metal nanostructures;

preparing a second aqueous solution consisting of water as the solvent and cations of a third metal and anions and cations associated with the cations of the third metal, the first metal and the third metal being different metals and each metal being selected from the group consisting of cerium, gold, lanthanum, iron, manganese, nickel, palladium, platinum, and vanadium; and mixing the precipitated first metal nanostructures with the second aqueous solution in an amount that reacts and dissolves a portion of the first metal nanostructures and precipitates the third metal on the undissolved first metal nanostructures to form bimetal nanostructures consisting of the first metal element and the third metal element.

* * * * *